US010160923B2

(12) United States Patent
Thakkar

(10) Patent No.: US 10,160,923 B2
(45) Date of Patent: Dec. 25, 2018

(54) PROCESSES FOR MAXIMIZING HIGH QUALITY DISTILLATE

(71) Applicant: UOP LLC, Des Plaines, IL (US)

(72) Inventor: Vasant P. Thakkar, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 14/533,760

(22) Filed: Nov. 5, 2014

(65) Prior Publication Data

US 2016/0122664 A1 May 5, 2016

(51) Int. Cl.

| | |
|---|---|
| ***C10G 65/12*** | (2006.01) |
| ***C10G 67/02*** | (2006.01) |
| ***C10G 45/02*** | (2006.01) |
| ***C10G 45/08*** | (2006.01) |
| ***C10G 45/12*** | (2006.01) |
| ***C10G 45/58*** | (2006.01) |
| ***C10G 45/64*** | (2006.01) |

(52) U.S. Cl.

CPC ..... *C10G 67/02* (2013.01); *C10G 45/02* (2013.01); *C10G 45/08* (2013.01); *C10G 45/12* (2013.01); *C10G 45/58* (2013.01); *C10G 45/64* (2013.01); *C10G 2300/104* (2013.01); *C10G 2300/1044* (2013.01); *C10G 2300/1048* (2013.01); *C10G 2400/02* (2013.01); *C10G 2400/04* (2013.01); *C10G 2400/06* (2013.01); *C10G 2400/08* (2013.01)

(58) Field of Classification Search

CPC ..... C10G 65/02; C10G 65/12

See application file for complete search history.

(56) References Cited

U.S. PATENT DOCUMENTS

| | | | | |
|---|---|---|---|---|
| 4,429,053 | A * | 1/1984 | Ward | B01J 29/126 208/111.01 |
| 5,447,621 | A * | 9/1995 | Hunter | C10G 65/12 208/58 |
| 6,261,441 | B1 | 7/2001 | Gentry et al. | |
| 8,591,726 | B2 | 11/2013 | Umansky et al. | |
| 8,632,675 | B2 | 1/2014 | Cole et al. | |
| 8,729,330 | B2 | 5/2014 | Hanks et al. | |
| 2011/0132803 | A1 | 6/2011 | Umansky et al. | |

(Continued)

OTHER PUBLICATIONS

"ExxonMobil Research and Engineering Company", Catalyst Review—Hydrocarbon Processing (2013), 18(1), 72-73.

(Continued)

*Primary Examiner* — Michelle Stein

(57) ABSTRACT

A process for producing a high quality distillate that meets the ultralow sulfur, cold flow, and distillation requirements. The feed stream is first hydrotreated and dewaxed in the same reactor to provide a hydrotreated and dewaxed effluent. The hydrotreated and dewaxed effluent is separated in a separation zone into a liquid and a vapor phase, the vapor phase comprising a hydrogen containing gas that can be recycled. The liquid phase is separated into at least a diesel stream and a heavy hydrocarbon stream. The heavy hydrocarbon stream is hydrocracked and the hydrocracked effluent may be passed to the reactor for hydrotreating and dewaxing or passed to the separation zone with the hydrotreated and dewaxed effluent.

17 Claims, 1 Drawing Sheet

(56) References Cited

U.S. PATENT DOCUMENTS

| | | | | |
|---|---|---|---|---|
| 2011/0315596 | A1* | 12/2011 | Prentice | C10G 45/64 208/59 |
| 2012/0248008 | A1* | 10/2012 | Dougherty | C10G 45/64 208/59 |
| 2012/0318712 | A1 | 12/2012 | Vannauker et al. | |

OTHER PUBLICATIONS

"PQS implements MIDW technology", Process Technology—World Refining (2000), 10(3), 33.

* cited by examiner

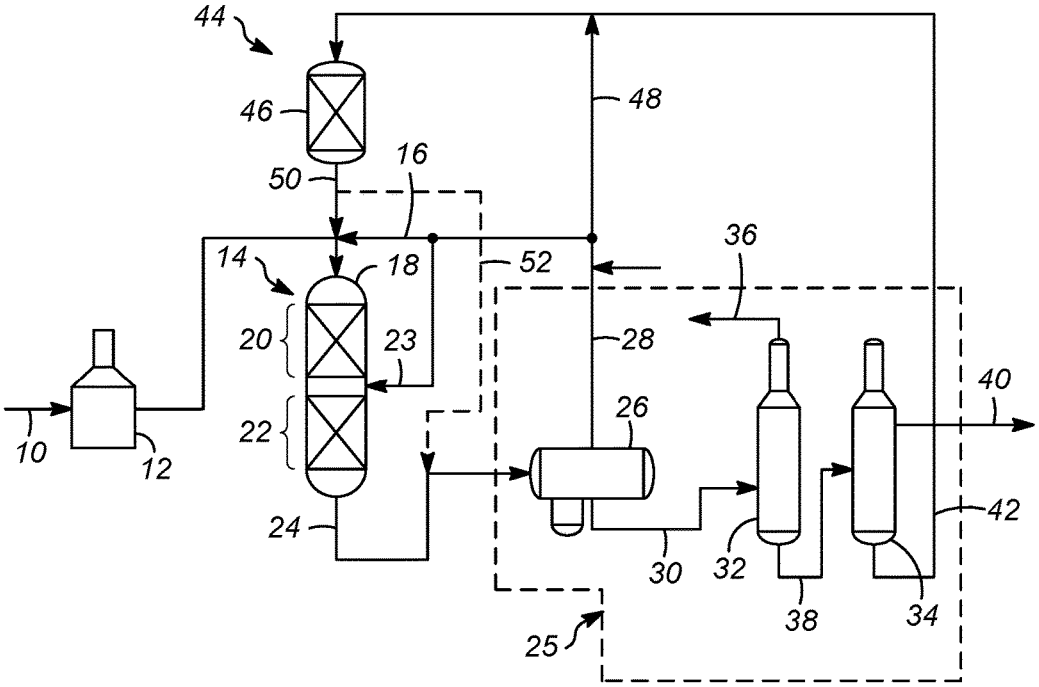
44
46
48
50
16
14
18
52
36
20
23
28
40
26
22
10
12
24
42
30
32
38
34
25

PROCESSES FOR MAXIMIZING HIGH QUALITY DISTILLATE

FIELD OF THE INVENTION

This invention relates generally to processes for producing high quality distillate, and more particularly to processes for producing high quality distillate that meets the ultralow sulfur, cold flow, and distillation requirements.

BACKGROUND OF THE INVENTION

Distillate demand is growing around the world over gasoline as a transportation fuel. The quality requirements for transportation fuel have and continue to become more and more stringent to alleviate environmental pollution concerns. These quality requirements typically require producing a low sulfur fuel with back end control to meet distillation specifications (such as T90 or T95).

In order to maximize yields from the production of such distillate fuels, hydrocracking is required for selectively cracking the heavier hydrocarbons in the hydrocarbon feed. However, subjecting the distillate range hydrocarbons in the hydrocarbon feed to the harsh conditions in the hydrocracking process can results in the undesired hydrocracking of these distillate range hydrocarbons. Thus, such processes may lower the yield by cracking some of the desired products during the hydrocracking step.

Additionally, the yield of such process can be also be limited by the cold flow properties of the distillate range hydrocarbons that are produced. Specifically, if the cold flow properties are unacceptable or outside of limits, the actual yield of acceptable product will be lower.

Therefore, there remains a need for an effective and efficient processes for recovering high quality distillate which meets the product specifications and processes which maximize the yield of same.

SUMMARY OF THE INVENTION

One or more process have been invented which maximize the yield of high quality distillate by first hydrotreating and dewaxing a hydrocarbon stream and then hydrocracking only the heavier, back end hydrocarbons.

Accordingly, in a first aspect of the present invention, the invention may be characterized as a process for producing a treated diesel stream by: passing a feed stream to a first reaction zone, the first reaction zone comprising a reactor having a hydrotreating zone and a dewaxing zone, the hydrotreating zone containing a hydrotreating catalyst and being operated under hydrotreating conditions to reduce an amount of at least one of nitrogen and sulfur in the feed stream, the dewaxing zone containing a dewaxing catalyst and being operated under dewaxing conditions to improve cold flow property, and the first reaction zone providing a first reactor effluent stream comprising a hydrotreated and dewaxed effluent; passing the first reactor effluent stream to a separation zone; separating a liquid phase of the first reactor effluent stream into a heavy portion and at least one light stream; and, passing the heavy portion of the first reactor effluent stream to a hydrocracking zone having an acidic hydrocracking catalyst, the hydrocracking zone being operated under hydrocracking conditions to provide a hydrocracked effluent stream.

In at least one embodiment of the present invention, the process also includes passing the hydrocracked effluent stream to the first reaction zone. It is contemplated that all of the hydrocracked effluent stream is passed to the first reaction zone. Alternatively, it is contemplated that the process includes passing the hydrocracked effluent stream from the hydrocracking zone to the separation zone.

In some embodiments of the present invention, the separation zone comprises at least one fractionation column, and the heavy portion of the first reactor effluent stream comprises a bottom stream from the fractionation column.

In one or more embodiments of the present invention, the process further includes separating the first reactor effluent stream into a vapor phase and the liquid phase.

In some embodiments of the present invention, the first reactor effluent stream is separated into a vapor phase and the liquid phase in a high pressure separator vessel. It is contemplated that the process includes passing a first portion of the vapor phase of the first reactor effluent stream to the first reaction zone. It is further contemplated that the process includes passing a second portion of the vapor phase of the first reactor effluent stream to the hydrocracking zone.

In at least one embodiment of the present invention, the separation zone comprises at least one separator vessel and at least one fractionation column. It is contemplated that the process includes recovering a diesel stream from the liquid portion of the first reactor effluent stream from the at least one fractionation column.

In another aspect of the present invention, the invention may be characterized as a process for process for producing a treated diesel stream by: hydrotreating a feed stream in a first reactor to lower an amount of at least one of nitrogen and sulfur in the feed stream; improving at least one cold flow property of the feed stream in the first reactor after the feed stream has been hydrotreated; recovering a first stream from an effluent stream the first reactor, the first stream comprising a diesel stream; and hydrocracking a second stream from the effluent stream in a second reactor in the presence of an acidic hydrocracking catalyst to form a hydrocracked effluent, the second stream from the effluent stream comprising a $C_{21}$+ hydrocarbon stream.

In some embodiments of the present invention, the process includes hydrotreating the hydrocracked effluent in the first reactor and improving at least one cold flow property of the hydrocracked effluent in the first reactor. It is contemplated that the first reactor includes at least one dewaxing catalyst for improving at least one cold flow property. It is further contemplated that the catalyst is a catalyst with a pore opening sufficient to reduce a pour point, a cloud point, a cold filter plug point, or a combination thereof of a diesel stream In some embodiments of the present invention, the process includes combining the hydrocracked effluent with the effluent stream from the first reactor to form a combined stream and passing the combined stream to a separation zone.

In one or more embodiments of the present invention, the process includes separating a third stream from the effluent stream from the first reactor, the third stream comprising a naphtha stream. It is contemplated that the naphtha stream is recovered from a first fractionation column, and wherein the diesel stream is recovered in a second fractionation column. It is further contemplated that the second fractionation column is downstream of the first fractionation column. It is also contemplated that the process includes recovering the $C_{21}$+ hydrocarbon stream from the second fractionation column.

In at least one embodiment of the present invention, the process includes recovering a vapor phase from the effluent stream from the first reactor. It is further contemplated that the process includes recycling a first portion of the vapor phase of the effluent stream from the first reactor to the first reactor and passing a second portion of the vapor phase of the effluent stream from the first reactor to the second reactor.

Additional aspects, embodiments, and details of the invention are set forth in the following detailed description of the invention.

DETAILED DESCRIPTION OF THE DRAWINGS

The drawing is a simplified process diagram in which the FIGURE depicts one or more embodiments of the present invention.

DETAILED DESCRIPTION OF THE INVENTION

One or more processes have been invented for providing high quality distillate by hydrotreating for ultralow sulfur specifications, dewaxing for improving the cold flow, and hydrocracking only the heavy, back end hydrocarbons to maximize distillate yields meeting desired specifications.

Typically, a distillate stream is drawn by a distillation of crude oil and will require hydrotreating to meet ultralow sulfur requirements for transportation fuel and to maximize yields. It is believed that between 20 to 30% of heavy, back end hydrocarbons may be present in the distillate stream that will not allow the stream to meet the distillation specifications. Additionally, depending upon the crude oil source, the distillation cold flow properties may need to be improved.

As described in more detail below, in various embodiments of the present invention, the entire feed stream is first hydrotreated and dewaxed. The hydrotreated and dewaxed effluent is then fractionated to recover majority of the distillate product meeting product specification, while the heavy, back end hydrocarbons may be hydrocracked to produce more distillate. Such a process as described herein can be employed by using conventional hydrotreating catalyst that contain Ni/Mo or Co/Mo or multi-metallic hydrotreating catalyst for achieving the desired sulfur target. Exemplary dewaxing catalysts include typical zeolitic dewaxing catalyst that include silicalite or a ZSM-5° type that is capable of cracking normal paraffins. Preferably, the dewaxing catalyst is a hydroisomerization catalyst for retaining maximum yields. These dewaxing catalysts may include a base or noble metal so that normal paraffins are isomerized with minimum cracking to achieve the desired or required cold flow properties for the product stream(s).

With reference to the attached drawings, one or more processes will now be described with the understanding that the following specific process are merely exemplary of the present invention.

As shown in the FIGURE, in various embodiments of the present invention, a feed stream 10 is passed through a charge heater 12 and then to a first reaction zone 14. The feed stream 10 may be mixed with, for example, a hydrogen containing gas 16 (discussed in more detail below).

The feed stream 10 may comprise a distillate stream from the fractionation of crude oil. Suitable feed streams 10 include distillable hydrocarbons preferably having boiling points above about 343° C. (650° F.). Some of these feed streams 10 are commonly referred to as heavy distillates, gas oils, light vacuum gas oil (LVGO). As is known, these feed streams 10 are typically prepared by fractionating crude oil in atmospheric and/or vacuum fractionation zones.

The first reaction zone 14 comprises at least one reactor 18 which includes a hydrotreating section 20 and a dewaxing section 22. Preferably, the reactor 18 comprises a downflow reactor, so that the feed stream 10 passes downward through the hydrotreating section 20, then through the dewaxing section 22, and then can be recovered as an effluent stream 24 from the reactor 18. Having passed through both the hydrotreating section 20 and the dewaxing section 22, the effluent stream 24 will comprise a hydrotreated and dewaxed effluent.

In the hydrotreating section 20, hydrogen, for example from the hydrogen containing gas 16 mixed with the feed stream 10, is used in the presence of one or more suitable catalysts which are primarily active for the removal of heteroatoms, such as sulfur and nitrogen, saturation of olefins and for some hydrogenation of aromatics in from the feed stream 10.

Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VI metal may be present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Typical hydrotreating conditions include temperatures ranging from about 204 to 482° C. (400 to 900° F.) and pressures ranging from about 3.6 to 17.3 MPag (500 to 2500 psig), preferably from about 3.6 to 13.9 MPag (500 to 2000 psig).

In the dewaxing section 22, one or more packed beds or trays include a catalyst that improves at least one cold flow property (i.e., pour point, cloud point, etc.) of the diesel range hydrocarbons. By "improving at least one cold flow property," it is meant that least about 10 percent (in another aspect, at least about 50 percent and, in yet another aspect, about 10 to about 90 percent) of the n-paraffins of the feed to the dewaxing section 22 are converted into iso-paraffins effective to provide an effluent with at least one of a cloud point value improved by about 5° C. or more, a pour point value improved by about 5° C. or more, and/or a cold filter plugging point value improved by about 5° C. or more. Dewaxing and hydrodewaxing processes are employed in the refining industry to treat petroleum fractions having initial boiling points over about 177° C. (350° F.) to improve at least one cold flow property. The improvement in pour point is generally effected by selective removal of normal paraffins or hydroisomerization of normal paraffins. Since the pour point of liquid hydrocarbon fuels, e.g., diesel fuels, shale oil, lube oils and other light gas oil fractions, are strictly controlled, the pour point specification of such fuels must be met if such are to be employed in their intended use.

Processes relating to dewaxing and hydroisomerization are well known in the art. Such processes have employed crystalline aluminosilicates as catalysts. For example, see U.S. Pat. Nos. 3,140,249; 3,140,252; 3,140,251; 3,140,253; 3,956,102; and 4,440,991. Further, ZSM type aluminosilicates have been disclosed for use in hydrocarbon conversion processes involving dewaxing. Representative patents include U.S. Pat. Nos. Re. 28,398; 3,700,585; 3,852,189; 3,980,550, 3,968,024; 4,247,388; 4,153,540; 4,229,282; 4,176,050; 4,222,855; 4,428,826; 4,446,007; 4,686,029. These and other patents disclose the use of various crystalline aluminosilicates as catalysts for dewaxing processes. Additionally, disclosure of a catalyst containing a crystalline silicate, as opposed to a crystalline aluminosilicate, is disclosed in U.S. Pat. No. 4,441,991.

Preferably, the dewaxing catalyst is a hydrodewaxing catalyst comprising a hydrogenating component on a support containing a dispersion of an intermediate—sized pore molecular sieve in a porous refractory oxide. Examples of such preferred catalysts typically comprise between 5 and 50 wt % of a Group VIB metal component and/or from about 2 to about 20 wt % of a Group VIII metal component together with a dewaxing component on a suitable refractory oxide. Preferred Group VIII metals include nickel and cobalt, and preferred Group VIB metals include molybdenum and tungsten. One of the most preferred hydrogenation component combinations is nickel-tungsten. Suitable refractory oxides include silica, silica-alumina, silica-magnesia, silica-titania and the like with alumina being preferred. The catalyst preferably comprises an intermediate pore crystalline molecular sieve having cracking activity, such as silicalite or an aluminosilicate having a high ratio of silica. Preferred catalysts include a support comprising the intermediate pore molecular sieve dispersed in an alumina matrix. Such supports can be produced, for example, by extruding a mixture of a 30 wt % molecular sieve dispersion in 70 wt % alumina. The alumina used in the support is a mixture preferably containing from about 50 to about 75 wt % gamma alumina and from about 25 to about 50 wt % peptized Catapal alumina. One preferred catalyst comprises about 4 wt % nickel (measured as NiO) and about 22 wt % tungsten (measured as $WO_3$) on a support comprising about 30 wt % of silicalite dispersed in about 70 wt % of the alumina mixture. An alternative preferred catalyst comprises a support of about 80 wt % silicalite dispersed in 20 wt % of the alumina mixture. Another alternative preferred catalyst is a hydroisomerization type catalyst containing noble metal.

In general, the dewaxing catalyst may comprise a hydroisomerization catalyst with a pore opening sufficient to improve a pour point, a cloud point, a cold filter plug point of a diesel stream. For example, a silicalite catalyst, a ZSM-5 catalyst, a beta zeolite catalyst, a catalyst with a Group VIII metal on a bound zeolite catalyst comprising metal supported on amorphous aluminosilicate or zeolite beta (beta), normally possess pores sufficiently sized (between 5.4 to 5.6 Å) to allow the formation of branch structures during paraffin isomerization. Examples of other molecular sieves with sufficiently sized pores include ZSM-3, ZSM-12, ZSM-20, MCM-37, MCM-68, ECR-5, SAPO-5, SAPO-37. Any number of suitable catalyst may be used and the present invention is not intended to be bound to any particular catalyst.

The operating conditions of the hydrodewaxing reactor preferably include pressures between about 3.5 to 17.2 MPag (500 to 2500 psig) and temperatures between about 232 to 427° C. (450 to 800° F.).

The effluent stream 24 from the reactor 18 is passed to a separation zone 25 which includes preferably includes a high pressure separator 26 preferably maintained at a pressure from about 3.5 to 17.2 MPag (500 to 2500 psig). A hydrogen-rich gaseous stream 28 is removed from the high pressure separator 26. At least a portion may be utilized as the hydrogen treat gas 16 to the first reactor 18. Additionally, a section portion may be utilized as the hydrogen containing gas 16 mixed with the feed stream 10 upstream of the reactor 18. A liquid hydrocarbon stream 30 is removed from the high pressure separator 26 and passed to a fractionation portion of the separation zone 25.

The fractionation portion of the separation zone 25 may include one or more fractionation columns 32, 34 that preferably produce product streams including naphtha and diesel. As shown, a first fractionation column 32 produces an overhead stream 36 comprising a naphtha stream. The bottom stream 38 from the first fractionation column 32 is passed to a second fractionation column 34. A side draw stream 40 from the second fractionation column 34 comprises a diesel stream. In this flow scheme as the diesel/distillate product is drawn via the side draw stream 40 on the second fractionation column 34 to allow color bodies like PNA and trace nitrogen or other impurities that cause color problem in the distillate product to drop out of the product stream. A bottoms stream 42 from the second fractionation column 34 comprises heavy hydrocarbons which can be converted to lower boiling point hydrocarbons. Accordingly, the bottoms stream 42 from the second fractionation column 34 is passed to a hydrocracking zone 44.

In the hydrocracking zone 44, the bottoms stream 42 from the separation zone 25 is passed to a hydrocracking reactor 46 which is typically operated in down-flow fashion and contains a hydrocracking catalyst comprising a hydrogenation component, for example a Group VIII metal component and/or a Group VIB metal component, generally dispersed on a support. More specifically, the hydrocracking catalyst typically contains between 5 and 50 wt % of a Group VIB metal component, measured as the trioxide, and/or between 2 and 20 wt % of a Group VIII metal component, measured as the monoxide, supported on a suitable refractory oxide. In order to provide an acidic base for the hydrocracking catalyst, the support may be an amorphous silica-alumina or zeolite. Other refractory oxides may also be utilized. The catalyst can be produced by conventional methods including impregnating a preformed catalyst support. Other methods include cogelling, co-mulling or precipitating the catalytic metals with the catalyst support followed by calcination. Preferred catalysts contain amorphous oxide supports which are extruded and subsequently impregnated with catalytic metals.

The first hydrocracking zone is preferably operated at conditions which include a temperature from about 232 to about 427° C. (450 to about 800° F.), a pressure from about 3.5 to about 17.2 MPa (500 to 2500 psig), and a liquid hourly space velocity from about 0.5 to about 5 $hr^{-1}$. The operating conditions in the first hydrocracking zone 44 are selected to preferably convert at least about 20% of the material in the bottoms stream 42 from the separation zone 25 into lighter hydrocarbons.

As is known, a hydrogen gas 48 may be mixed with the bottoms stream 42 upstream of the hydrocracking reactor 46. In a preferred embodiment, the hydrogen gas 48 may comprise a portion of the hydrogen-rich gaseous stream 28 from the high pressure separator 26.

A hydrocracked effluent stream 50 from the hydrocracking reactor 46 may then passed to the first reaction zone 14, and more particularly to the reactor 18 in the first reaction zone 14. Although the hydrocracked effluent stream 50 is depicted as being combined with the fresh feed 10 and the hydrogen gas 16, it is not required as such for the practicing of the present invention. The hydrocracked effluent will pass through the hydrotreating sections 20 and dewaxing sections 22, and any naphtha and diesel range hydrocarbons can be recovered in the separation zone 25.

Alternatively, as also shown in the FIGURE, the hydrocracked effluent stream 50 may be passed from the hydrocracking reactor 46 to the separation zone 25 (shown as dashed line 52). For example, the hydrocracking reactor 46 may be combined with the effluent stream 24 from the reactor 18 in the first reaction zone 14 to form a combined stream which is passed to the separation zone 25. The hydrocarbons in the hydrocracked effluent stream 50 can be separated as described above.

In either instances, passing the hydrocracked effluent stream 50 to the first reaction zone 14, or passing the hydrocracked effluent stream 50 to the separation zone 25, by only utilizing the hydrocracking reactor 46 with the heavier hydrocarbons from the feed stream 10, the cracking of the native distillate range hydrocarbons in the feed stream 10 can be avoided.

Further, in those embodiments in which the hydrocracked effluent stream 50 is passed to the first reaction zone 14, the produced diesel product will meet the specifications for ultralow sulfur diesel. Additionally, the hydrocracked effluent stream 50 may be passed over the hydrotreating and dewaxing catalyst to minimize any quench gas requirements and to polish the hydrocracked product to ensure that the sulfur and cold flow properties of the diesel product are met.

It is also believed that this flow scheme may alleviate any discoloration problems of the distillate due to excessively high hydrotreating catalyst temperature that may occur in a standalone diesel hydrotreating unit.

In sum, the various process can provide three independent controls for hydrotreating, dewaxing, and hydrocracking reactions in single process based upon the selection of the catalyst type and operating conditions of the various reactors.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understating the embodiments of the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for producing a treated diesel stream, the process comprising:

passing a feed stream to a first reaction zone, the first reaction zone comprising a reactor having a hydrotreating zone and a dewaxing zone, the hydrotreating zone containing a hydrotreating catalyst and being operated under hydrotreating conditions to reduce an amount of at least one of nitrogen and sulfur in the feed stream, the dewaxing zone containing a dewaxing catalyst and being operated under dewaxing conditions, and the first reaction zone providing a first reactor effluent stream comprising a hydrotreated and dewaxed effluent;

passing the first reactor effluent stream to a separation zone;

separating a liquid phase of the first reactor effluent stream into a heavy portion and at least one light stream;

passing the heavy portion of the first reactor effluent stream to a hydrocracking zone having an acidic hydrocracking catalyst, the hydrocracking zone being operated under hydrocracking conditions to provide a hydrocracked effluent stream; and, passing the hydrocracked effluent stream to the first reaction zone.

2. The process of claim 1, wherein the separation zone comprises at least one fractionation column, and the heavy portion of the first reactor effluent stream comprises a bottom stream from the fractionation column.

3. The process of claim 1 further comprising:

separating the first reactor effluent stream into a vapor phase and the liquid phase.

4. The process of claim 3 wherein the first reactor effluent stream is separated into a vapor phase and the liquid phase in a high pressure separator vessel.

5. The process of claim 4 further comprising:

passing a first portion of the vapor phase of the first reactor effluent stream to the first reaction zone.

6. The process of claim 5 further comprising:

passing a second portion of the vapor phase of the first reactor effluent stream to the hydrocracking zone.

7. The process of claim 1, wherein the separation zone comprises at least one separator vessel and at least one fractionation column.

8. The process of claim 7 further comprising:

recovering a diesel stream from the liquid portion of the first reactor effluent stream from the at least one fractionation column.

9. A process for producing a treated diesel stream, the process comprising:

hydrotreating a feed stream in a first reaction zone having a first reactor to lower an amount of at least one of nitrogen and sulfur in the feed stream;

improving at least one cold flow property of the feed stream in the first reactor after the feed stream has been hydrotreated;

separating, in a separator and a fractionation column, a first stream from an effluent stream from the first reactor, the first stream comprising a diesel stream; and, hydrocracking a second stream from the effluent stream in a second reactor in the presence of an acidic hydrocracking catalyst to form a hydrocracked effluent, the second stream from the effluent stream comprising a C21+ hydrocarbon stream; and, passing the hydrocracked effluent to the first reaction zone.

10. The process of claim 9 further comprising:

hydrotreating the hydrocracked effluent in the first reactor; and, improving at least one cold flow property of the hydrocracked effluent in the first reactor.

11. The process of claim 10, wherein the first reactor includes at least one dewaxing catalyst for improving at least one cold flow property.

12. The process of claim 9 further comprising:

separating a third stream from the effluent stream from the first reactor, the third stream comprising a naphtha stream.

13. The process of claim 12 wherein the naphtha stream is recovered from a first fractionation column, and wherein the diesel stream is recovered in a second fractionation column.

14. The process of claim 13, wherein the second fractionation column is downstream of the first fractionation column.

15. The process of claim 14, further comprising:

recovering the C21+ hydrocarbon stream from the second fractionation column.

16. The process of claim 9 further comprising:

recovering a vapor stream from the effluent stream from the first reactor.

17. The process of claim 16 further comprising:

recycling a first portion of the vapor stream of the effluent stream from the first reactor to the first reactor; and, passing a second portion of the vapor stream of the effluent stream from the first reactor to the second reactor.

* * * * *